US010340629B2

(12) United States Patent
Tada

(10) Patent No.: US 10,340,629 B2
(45) Date of Patent: Jul. 2, 2019

(54) WATERPROOF CONNECTOR AND MANUFACTURING METHOD THEREOF

(71) Applicant: Japan Aviation Electronics Industry, Limited, Tokyo (JP)

(72) Inventor: Takashi Tada, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/970,065

(22) Filed: May 3, 2018

(65) Prior Publication Data

US 2019/0027859 A1 Jan. 24, 2019

(30) Foreign Application Priority Data

Jul. 19, 2017 (JP) ..... 2017-139872

(51) Int. Cl.

| | |
|---|---|
| ***H01R 13/52*** | (2006.01) |
| ***H01R 13/11*** | (2006.01) |
| ***H01R 43/00*** | (2006.01) |
| ***H01R 43/24*** | (2006.01) |
| *H01R 24/60* | (2011.01) |

(52) U.S. Cl.

CPC ..... *H01R 13/5219* (2013.01); *H01R 13/11* (2013.01); *H01R 13/521* (2013.01); *H01R 13/5216* (2013.01); *H01R 43/005* (2013.01); *H01R 43/24* (2013.01); *H01R 24/60* (2013.01)

(58) Field of Classification Search

CPC .. H01R 13/5219; H01R 13/11; H01R 13/521; H01R 43/005

USPC ..... 439/718

See application file for complete search history.

(56) References Cited

U.S. PATENT DOCUMENTS

| | | | | |
|---|---|---|---|---|
| 9,225,130 | B2 * | 12/2015 | Zhang | H01R 13/405 |
| 9,331,433 | B2 * | 5/2016 | Ueda | H01R 13/6581 |
| 9,350,121 | B2 * | 5/2016 | Ju | H01R 13/6585 |
| 9,356,400 | B2 * | 5/2016 | Little | H01R 4/023 |
| 9,496,653 | B2 * | 11/2016 | Little | H01R 12/724 |
| 9,595,796 | B2 * | 3/2017 | Yen | H01R 13/6581 |
| 9,728,885 | B2 * | 8/2017 | Yokoyama | H01R 13/42 |
| 9,847,595 | B2 * | 12/2017 | Tsai | H01R 13/521 |
| 9,905,944 | B2 * | 2/2018 | Little | H01R 13/6658 |
| 9,960,522 | B2 * | 5/2018 | Tada | H01R 12/707 |
| 10,116,107 | B2 * | 10/2018 | Tada | H01R 24/60 |

(Continued)

FOREIGN PATENT DOCUMENTS

JP 5905952 B1 4/2016

*Primary Examiner* — Alexander Gilman

(74) *Attorney, Agent, or Firm* — Muncy, Geissler, Olds & Lowe, P.C.

(57) ABSTRACT

A waterproof connector to be mounted on a substrate includes one or more contacts, a peripheral shell in a cylindrical shape surrounding the one or more contacts and including a counter-connector accommodation portion that opens frontward in a fitting direction, and a housing made of insulating resin and holding the one or more contacts and the peripheral shell, the peripheral shell including a shell front end exposure portion in a cylindrical shape that is situated at a front end of the peripheral shell in the fitting direction and is exposed from the housing, and one or more through-holes that penetrate the shell front end exposure portion in a direction intersecting the fitting direction, and the housing tightly covering a whole circumference of the peripheral shell with the shell front end exposure portion being exposed.

10 Claims, 12 Drawing Sheets

(56) References Cited

U.S. PATENT DOCUMENTS

| | | | | |
|---|---|---|---|---|
| 2016/0064870 | A1* | 3/2016 | Yu | H01R 24/60<br>439/607.05 |
| 2016/0322759 | A1* | 11/2016 | Park | H01R 13/6585 |
| 2016/0365673 | A1* | 12/2016 | Liang | H01R 12/57 |
| 2017/0054256 | A1* | 2/2017 | Yokoyama | H01R 13/648 |
| 2017/0222374 | A1* | 8/2017 | Saito | H01R 13/6581 |
| 2017/0271820 | A1* | 9/2017 | Ho | H01R 13/6585 |

* cited by examiner

WATERPROOF CONNECTOR AND MANUFACTURING METHOD THEREOF

BACKGROUND OF THE INVENTION

The present invention relates to a waterproof connector and a manufacturing method thereof, particularly to a waterproof connector having a plurality of contacts and a peripheral shell as well as a method of manufacturing thereof.

In recent years, portable electronic devices have been widely used. Such electronic devices are required to have an excellent waterproof function. Accordingly, connectors for use in electronic devices are also required to have waterproof properties.

For instance, a connector disclosed in JP 5905952 B includes a plurality of contacts 1, a metallic ground plate 2 disposed parallel to the contacts 1, an insulator 3 made of insulating resin and holding the contacts 1 and the ground plate 2, a mid-plate 4 embedded in the insulator 3, and a metallic peripheral shell 5 covering the peripheral portion of the insulator 3, as shown in FIG. 22. The peripheral shell 5 has a counter-connector accommodation portion 6 that opens frontward in a fitting direction. Since the space between the contacts 1 and the ground plate 2 is filled with the insulating resin constituting the insulator 3, it is unlikely that moisture in the atmosphere or the like causes formation of an electric path between the contacts 1 and the ground plate 2.

In the connector disclosed by JP 5905952 B, however, the spaces between the contacts 1 and the ground plate 2 and between the contacts 1 and the peripheral shell 5 are only filled with the insulating resin constituting the insulator 3, and hence, a water entering path may be formed between the insulator 3 and an inner surface of the peripheral shell 5.

In order to prevent such a water entering path from being formed between the insulator 3 and the inner surface of the peripheral shell 5, the insulator 3 is desirably configured to, for instance, cover the peripheral shell 5 from its rear end through its peripheral surface. To obtain the insulator 3 as above, however, resin molding has to be carried out such that the resin covers the peripheral shell 5 from its rear end through its peripheral surface with the contacts 1, the ground plate 2 and the mid-plate 4 being disposed inside the peripheral shell 5, and it is difficult to finish the molding in a single process. Considering that the insulator 3 to be inserted in the peripheral shell 5 is molded in a primary molding process as shown in FIG. 22 and then another insulator to cover the peripheral shell 5 from its rear end through its peripheral surface is molded in a secondary molding process, it is necessary to secure the connector in position by placing the rear end of the insulator 3 so that the rear end abuts a mold for the other insulator. Therefore, part of the insulator 3 may be exposed even after the other insulator is molded, which may lead to formation of a water entering path.

SUMMARY OF THE INVENTION

The present invention has been made to eliminate the conventional drawback as above and is aimed at providing a waterproof connector that can have improved waterproof properties between an insulator and a peripheral shell, as well as a method of manufacturing the waterproof connector.

A waterproof connector according to the present invention comprises:

one or more contacts;

a peripheral shell in a cylindrical shape surrounding the one or more contacts and including a counter-connector accommodation portion that opens frontward in a fitting direction; and a housing made of insulating resin and holding the one or more contacts and the peripheral shell, wherein the peripheral shell includes a shell front end exposure portion in a cylindrical shape that is situated at a front end of the peripheral shell in the fitting direction and is exposed from the housing, and one or more through-holes that penetrate the shell front end exposure portion in a direction intersecting the fitting direction, and wherein the housing tightly covers a whole circumference of the peripheral shell with the shell front end exposure portion being exposed.

A method of manufacturing a waterproof connector having one or more contacts, a peripheral shell in a cylindrical shape surrounding the one or more contacts and including a counter-connector accommodation portion that opens frontward in a fitting direction, and a housing made of insulating resin and holding the one or more contacts and the peripheral shell, the peripheral shell including a shell front end exposure portion in a cylindrical shape that is situated at a front end of the peripheral shell in the fitting direction and is exposed from the housing, the method comprising the steps of:

forming a subassembly in which the peripheral shell is disposed against the one or more contacts to surround the one or more contacts;

securing the subassembly in position by fitting a protrusion formed on one of a molding mold and the shell front end exposure portion of the peripheral shell into a recess formed in the other of the molding mold and the shell front end exposure portion of the peripheral shell; and injecting molten insulating resin into the molding mold such that a whole circumference of the peripheral shell is tightly covered with the insulating resin while the shell front end exposure portion is exposed.

DETAILED DESCRIPTION OF THE INVENTION

An embodiment of the present invention is described below based on the appended drawings.

Figure 1:
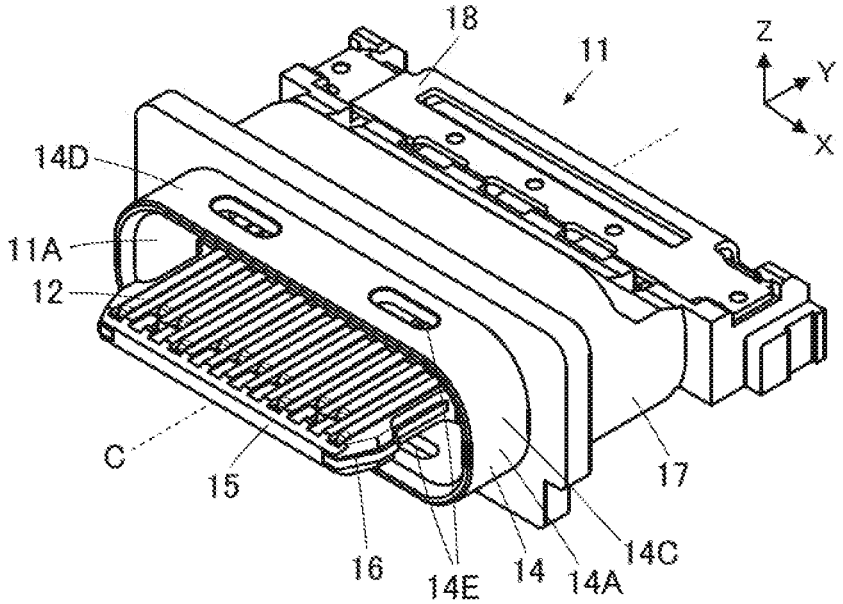
FIG. 1 is a perspective view of a waterproof connector according to Embodiment of the present invention when viewed from an obliquely upper position.
Figure 2:
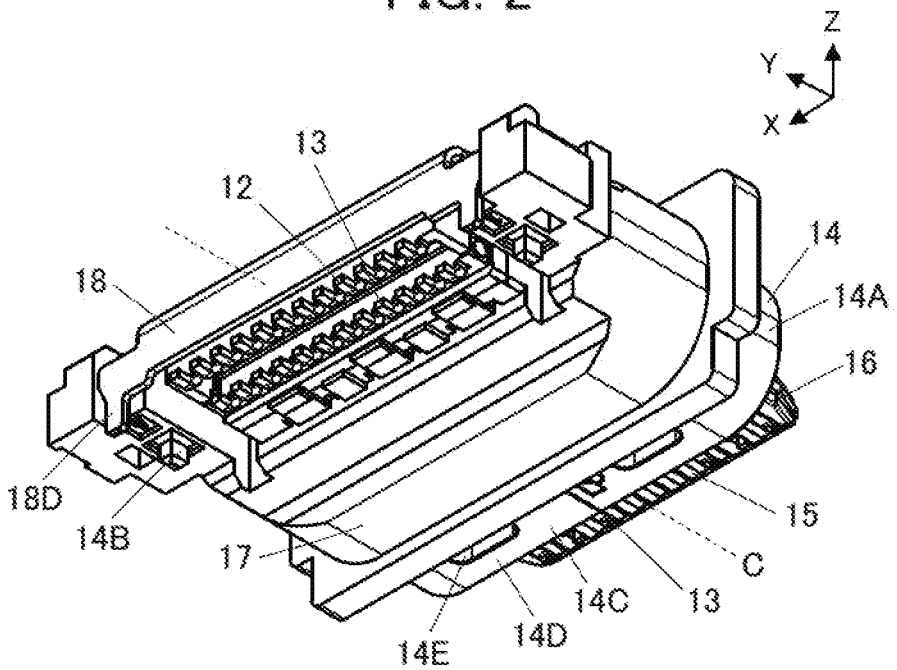
FIG. 2 is a perspective view of the waterproof connector according to Embodiment when viewed from an obliquely lower position.

FIGS. 1 and 2 show a waterproof connector 11 according to Embodiment. The waterproof connector 11 is a receptacle connector to be fixed to a substrate in an electronic device such as a mobile device or an information appliance, and includes a counter-connector accommodation portion 11A that opens frontward in a fitting direction along a fitting axis C, a plurality of first contacts 12 that extend in the fitting axis C direction and are arranged in a direction perpendicular to the fitting axis C, and a plurality of second contacts 13 that extend in the fitting axis C direction and are arranged parallel to the first contacts 12. The first contacts 12 and the second contacts 13 extend inside the counter-connector accommodation portion 11A and are exposed in front and back in the fitting direction.

For convenience, the direction from front to back of the waterproof connector 11 along the fitting axis C is called "+Y direction," the arrangement direction of the first contacts 12 and the second contacts 13 "+X direction," and the direction from the second contacts 13 to the first contacts 12 that is perpendicular to an XY plane "+Z direction."

A metallic peripheral shell 14 extends along the fitting axis C so as to cover the periphery of front end portions, i.e., −Y direction-side portions of the first and second contacts 12 and 13. The front end, i.e., −Y direction-side portion of the peripheral shell 14 is provided with a flattened cylindrical portion 14A having a substantially elliptical sectional shape, and the counter-connector accommodation portion 11A of the waterproof connector 11 is formed inside the cylindrical portion 14A. The +Y directional end of the cylindrical portion 14A is provided with a pair of arm portions (not shown) extending separately from the +X and −X directional ends of the cylindrical portion 14A in the +Y direction, and the +Y directional ends of the arm portions are each provided with a substrate mount portion 14B extending in the −Z direction. The peripheral shell 14 has a shell front end exposure portion 14C that is exposed from a second insulator 17, which will be described later, toward the −Y direction, and the shell front end exposure portion 14C has a pair of flat portions 14D facing each other in the Z direction. The pair of flat portions 14D extend along an XY plane and each have two through-holes 14E penetrating the relevant flat portion 14D in the Z direction.

The cylindrical portion 14A of the peripheral shell 14 that forms the counter-connector accommodation portion 11A houses a first insulator 15 made of insulating resin. The first insulator 15 holds middle portions of the individual first and second contacts 12 and 13. A metallic mid-plate 16 is embedded in the first insulator 15 to lie between the first contacts 12 and the second contacts 13.

The second insulator 17 made of insulating resin is molded to cover the peripheral portion of the rear end, i.e., +Y directional end of the cylindrical portion 14A of the peripheral shell 14 and to allow the middle portions of the individual first and second contacts 12 and 13 to be embedded therein. The pair of arm portions (not shown) of the peripheral shell 14 are also embedded in the second insulator 17, and as shown in FIG. 2, the substrate mount portions 14B formed at the +Y direction ends of the arm portions project in the −Z direction from the second insulator 17.

A metallic back shell 18 covering the back portions of the first and second contacts 12 and 13 is disposed at the rear end of the second insulator 17. The back shell 18 has a pair of substrate mount portions 18D projecting in the −Z direction.

Figure 3:
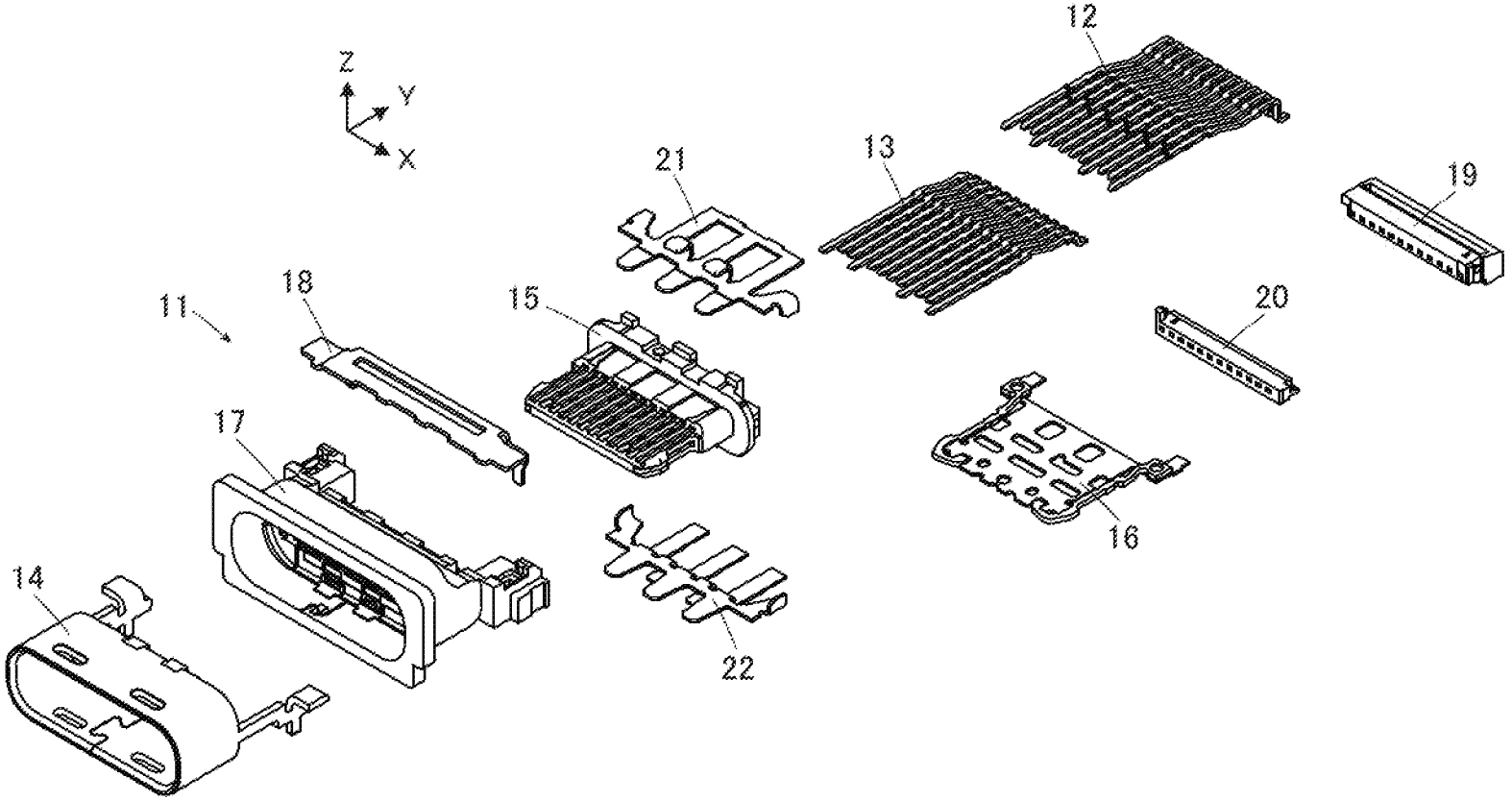
FIG. 3 is an exploded view of the waterproof connector according to Embodiment.

FIG. 3 shows an exploded view of the waterproof connector 11. The waterproof connector 11 includes, in addition to the first contacts 12, the second contacts 13, the peripheral shell 14, the first insulator 15, the mid-plate 16, the second insulator 17 and the back shell 18 shown in FIGS. 1 and 2, a first contact insulator 19 for integrating the first contacts 12, a second contact insulator 20 for integrating the second contacts 13, and a first ground plate 21 and a second ground plate 22 that are made of metal and attached to the first insulator 15. The first insulator 15, the second insulator 17, the first contact insulator 19 and the second contact insulator 20 constitute a housing of the waterproof connector 11.

Figure 4:
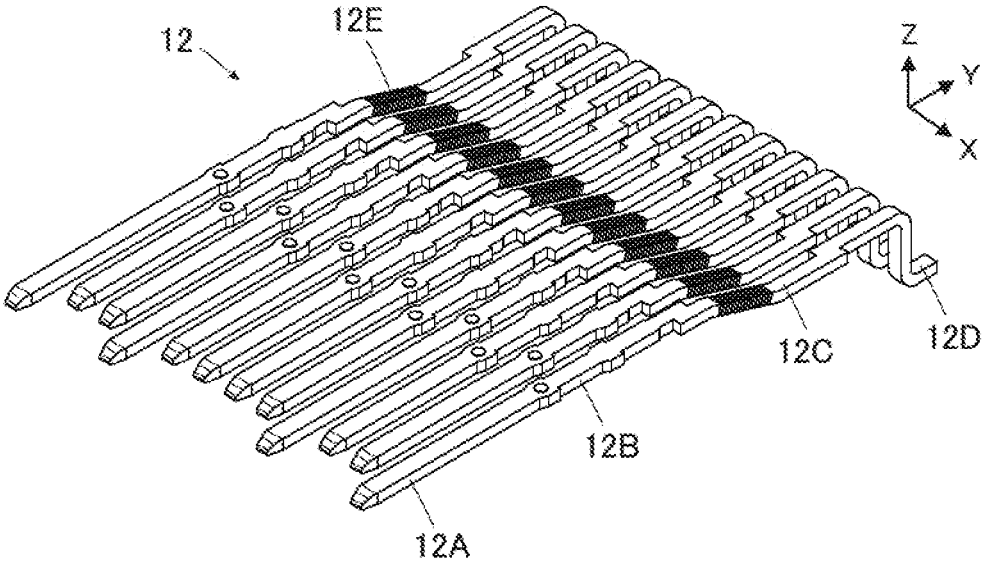
FIG. 4 is a perspective view showing a plurality of first contacts used in the waterproof connector according to Embodiment.

As shown in FIG. 4, each first contact 12 is composed of a plate-like member extending substantially in the Y direction, and includes a contact portion 12A that is situated at the −Y directional end of the first contact 12 to be exposed from the first insulator 15 and a press-fitted portion 12B that lies adjacent to the +Y directional end of the contact portion 12A to be press-fitted in the first insulator 15. Each first contact 12 further includes a fixed portion 12C that lies adjacent to the +Y directional end of the press-fitted portion 12B to be fixed to the second insulator 17 and a substrate connection portion 12D that lies adjacent to the +Y directional end of the fixed portion 12C to be exposed from the second insulator 17 in the +Y direction. The fixed portion 12C of the first contact 12 is inclined with respect to the Y direction so as to be displaced in the −Z direction as advancing from the press-fitted portion 12B to the substrate connection portion 12D. The surface of the fixed portion 12C is formed with a first contact waterproof shaped portion 12E made up of a plurality of grooves surrounding and enclosing the periphery of the fixed portion 12C.

Figure 5:
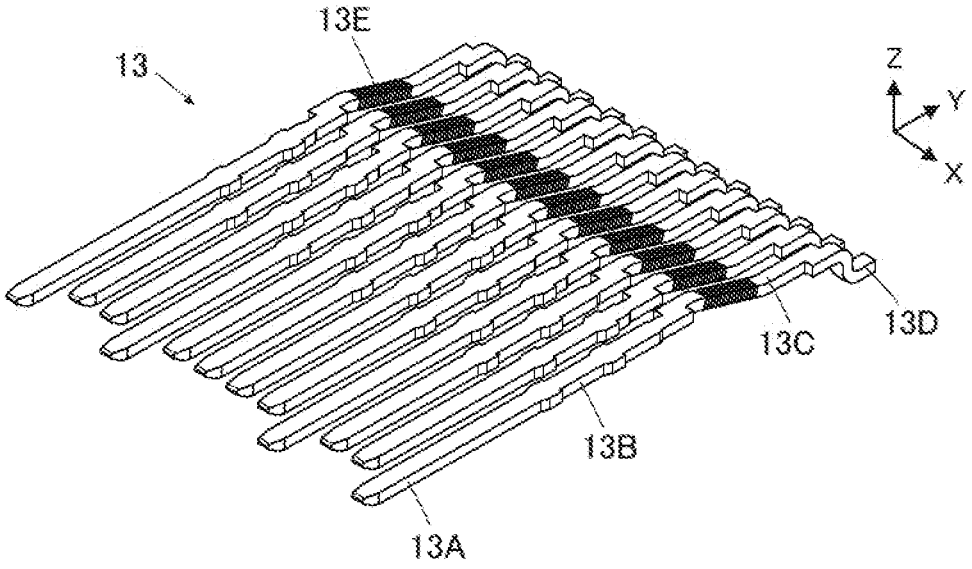
FIG. 5 is a perspective view showing a plurality of second contacts used in the waterproof connector according to Embodiment.

As shown in FIG. 5, as with the first contacts 12, each second contact 13 is also composed of a plate-like member extending substantially in the Y direction, and includes a contact portion 13A that is situated at the −Y directional end of the second contact 13 to be exposed from the first insulator 15 and a press-fitted portion 13B that lies adjacent to the +Y directional end of the contact portion 13A to be press-fitted in the first insulator 15. Each second contact 13 further includes a fixed portion 13C that lies adjacent to the +Y directional end of the press-fitted portion 13B to be fixed to the second insulator 17 and a substrate connection portion 13D that lies adjacent to the +Y directional end of the fixed portion 13C to be exposed from the second insulator 17 in the +Y direction. The fixed portion 13C of the second contact 13 is inclined so as to be displaced in the −Z direction as advancing from the press-fitted portion 13B to the substrate connection portion 13D. The surface of the fixed portion 13C is formed with a second contact waterproof shaped portion 13E made up of a plurality of grooves surrounding and enclosing the periphery of the fixed portion 13C.

Figure 6:
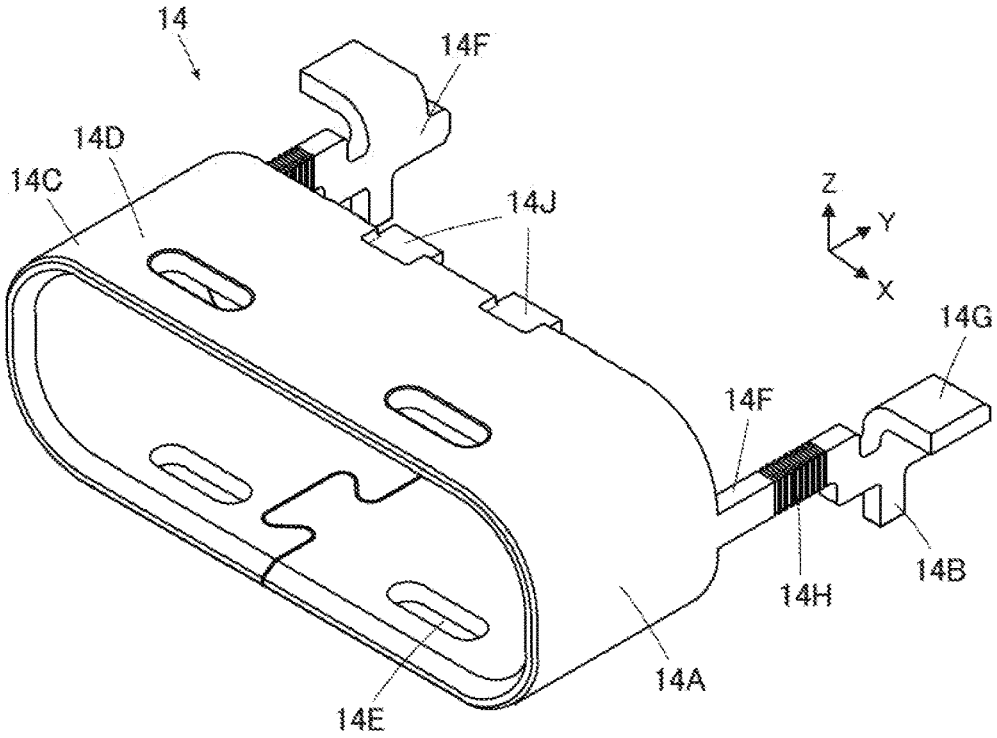
FIG. 6 is a perspective view showing a peripheral shell used in the waterproof connector according to Embodiment.

As shown in FIG. 6, the cylindrical portion 14A of the peripheral shell 14 is provided at its +Y directional end with a pair of peripheral shell arm portions 14F that extend separately from the +X and −X directional ends of the cylindrical portion 14A in the +Y direction along a YZ plane. The +Y directional ends of the peripheral shell arm portions 14F are each provided with a substrate mount portion 14B projecting in the −Z direction and a back shell connection portion 14G facing in the +Z direction and extending in an XY plane. The surface of the middle portion of each peripheral shell arm portion 14F is formed with a peripheral shell waterproof shaped portion 14H made up of a plurality of grooves surrounding and enclosing the periphery of the peripheral shell arm portion 14F. Upon molding the second insulator 17, the peripheral shell arm portions 14F, including the peripheral shell waterproof shaped portions 14H, are embedded in the second insulator 17 except for the substrate mount portions 14B and the back shell connection portions 14G being exposed from the second insulator 17.

Further, ground plate connection portions 14J are formed at two locations in a middle portion of the +Y directional end of each of the outer surfaces of the cylindrical portion 14A facing in the +Z and −Z directions.

Figure 7:
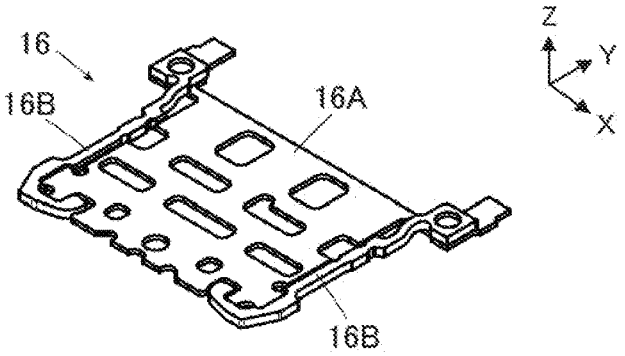
FIG. 7 is a perspective view showing a mid-plate used in the waterproof connector according to Embodiment.
Figure 8:
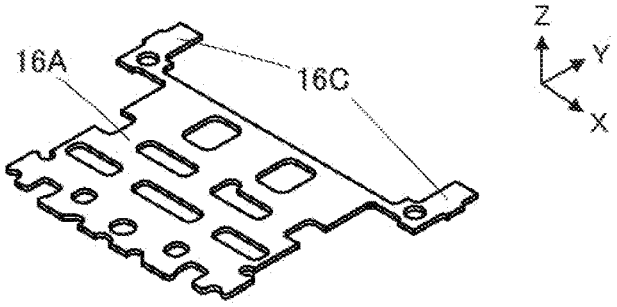
FIG. 8 is a perspective view showing a mid-plate body used in the waterproof connector according to Embodiment.

As shown in FIG. 7, the mid-plate 16 is composed of a mid-plate body 16A and a pair of mid-plate lateral members 16B disposed separately at the +X and −X directional ends of the mid-plate body 16A. As shown in FIG. 8, the mid-plate body 16A is a metallic plate-like member extending along an XY plane and is provided at its +Y directional end with a pair of ground plate connection portions 16C projecting in the +Y direction separately from the +X and −X directional ends of the mid-plate body 16A.

Figure 9:
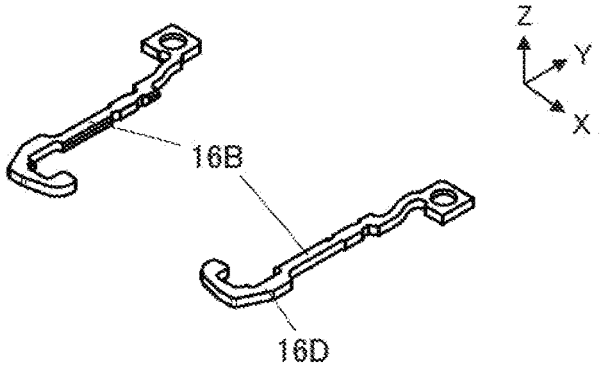
FIG. 9 is a perspective view showing a pair of mid-plate lateral members used in the waterproof connector according to Embodiment.

As shown in FIG. 9, the pair of mid-plate lateral members 16B are metallic members formed to extend along an XY plane and be thicker in the Z direction than the mid-plate body 16A, and are each provided at its −Y directional end with a hook portion 16D for catching the mid-plate body 16A.

The mid-plate 16 shown in FIG. 7 is formed by combining the mid-plate body 16A and the pair of mid-plate lateral members 16B by, for instance, stamping. In this process, the pair of mid-plate lateral members 16B come into contact separately with the +X and −X directional ends of the mid-plate body 16A.

Figure 10:
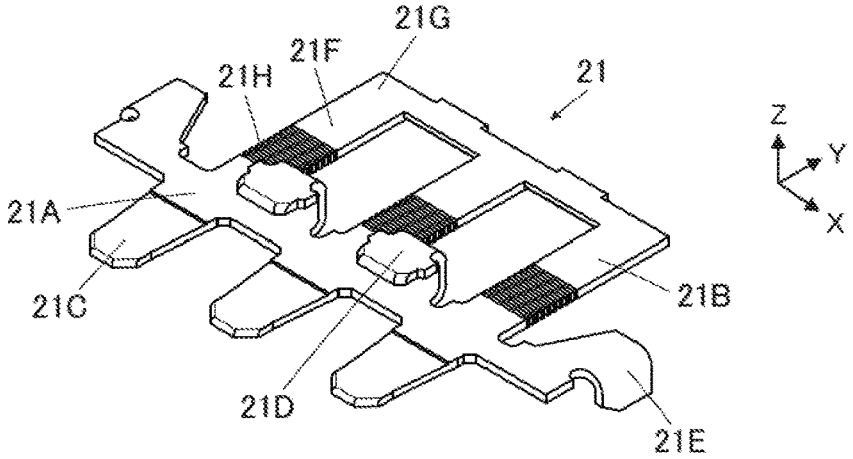
FIG. 10 is a perspective view showing a first ground plate used in the waterproof connector according to Embodiment.

As shown in FIG. 10, the first ground plate 21 includes a first ground plate body 21A of flat plate shape, three first ground plate arm portions 21B of flat plate shape extending from the first ground plate body 21A in the +Y direction along an XY plane, and three plate tip ends 21C of flat plate shape extending from the first ground plate body 21A in the −Y direction along an XY plane. The three first ground plate arm portions 21B are connected to each other at their +Y directional ends. There are further provided two shell connection portions 21D projecting from the first ground plate body 21A in the +Z direction and then extending in an XY plane and a pair of mid-plate connection portions 21E extending out of the first ground plate 21 from the +X and −X directional ends of the first ground plate body 21A along an XY plane and then projecting in the −Z direction.

The three first ground plate arm portions 21B separately have plate middle portions 21F and interconnected plate rear ends 21G, and when the second insulator 17 is molded, the plate middle portions 21F are embedded in the second insulator 17 while the plate rear ends 21G are exposed from the second insulator 17 in the +Y direction. The surface of each plate middle portion 21F is formed with a first ground plate waterproof shaped portion 21H made up of a plurality of grooves surrounding and enclosing the periphery of the plate middle portion 21F.

Figure 11:
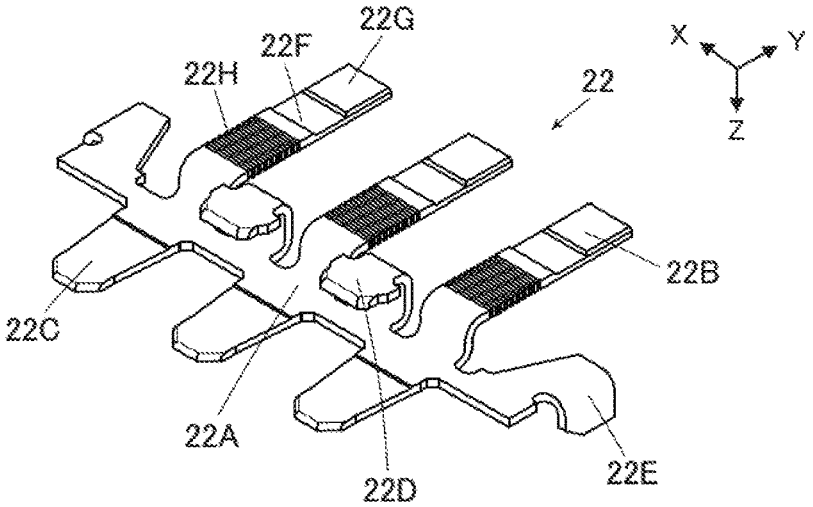
FIG. 11 is a perspective view showing a second ground plate used in the waterproof connector according to Embodiment.

As shown in FIG. 11, the second ground plate 22 includes a second ground plate body 22A of flat plate shape, three second ground plate arm portions 22B extending from the second ground plate body 22A in the −Z direction and then bending to extend in the +Y direction along an XY plane, and three plate tip ends 22C extending from the second ground plate body 22A in the −Y direction along an XY plane. There are further provided two shell connection portions 22D projecting from the second ground plate body 22A in the −Z direction and then extending in an XY plane and a pair of mid-plate connection portions 22E extending out of the second ground plate 22 from the +X and −X directional ends of the second ground plate body 22A along an XY plane and then projecting in the +Z direction.

The three second ground plate arm portions 22B separately have plate middle portions 22F and plate rear ends 22G, and when the second insulator 17 is molded, the plate middle portions 22F are embedded in the second insulator 17 while the plate rear ends 22G are exposed from the second insulator 17 in the +Y direction. The surface of each plate middle portion 22F is formed with a second ground plate waterproof shaped portion 22H made up of a plurality of grooves surrounding and enclosing the periphery of the plate middle portion 22F.

Figure 12:
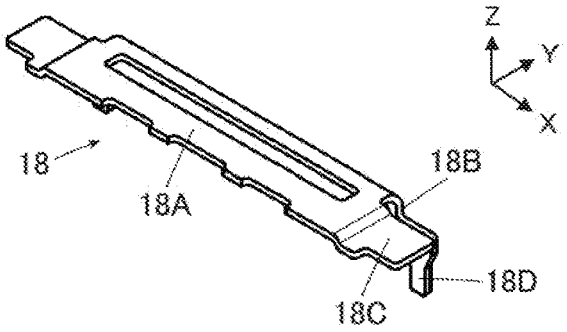
FIG. 12 is a perspective view showing a back shell used in the waterproof connector according to Embodiment.

As shown in FIG. 12, the back shell 18 includes an upper surface portion 18A of flat plate shape extending along an XY plane and a back portion 18B of flat plate shape bending from the +Y directional end of the upper surface portion 18A to extend in the −Z direction along an XZ plane. The upper surface portion 18A is provided at its +X and −X directional ends with overhanging portions 18C separately projecting along an XY plane. The substrate mount portions 18D project separately from the +X and −X directional ends of the back portion 18B to extend in the −Z direction along an XZ plane.

Next, the method of manufacturing the waterproof connector 11 according to Embodiment is described.

Figure 13:
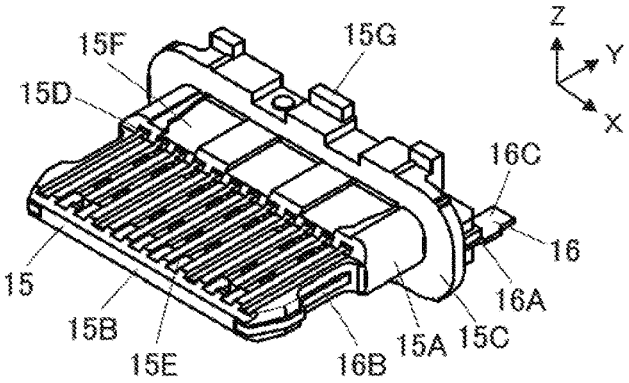
FIG. 13 is a perspective view showing a first insulator holding the mid-plate.

First, the mid-plate 16 is placed in a primary-molding mold, which is not shown, and molten insulating resin is injected into the primary-molding mold to thereby mold the first insulator 15 in which the mid-plate 16 is embedded as shown in FIG. 13.

The first insulator 15 thus molded includes a first insulator body 15A, a tongue portion 15B extending from the first insulator body 15A in the −Y direction, and a wall-like portion 15C projecting from the +Y directional end of the first insulator body 15A in the X direction and the Z direction along an XZ plane.

A plurality of contact through-holes 15D extending in the Y direction are formed in the first insulator body 15A for press-fitting the first contacts 12 and the second contacts 13, and a plurality of contact grooves 15E extending in the Y direction and connected to the corresponding contact through-holes 15D are formed in the +Z and −Z direction-side surfaces of the tongue portion 15B. Three flat surfaces 15F are formed on each of the +Z and −Z direction-side surfaces of the first insulator body 15A. Those flat surfaces 15F are separately connected to slits penetrating the wall-like portion 15C in the Y direction.

The wall-like portion 15C is provided at its +Z and −Z directional ends with a plurality of projections 15G projecting separately in the +Z and −Z directions.

When the first insulator 15 is molded, the mid-plate body 16A of the mid-plate 16 is embedded in the tongue portion 15B of the first insulator 15, and the mid-plate lateral members 16B of the mid-plate 16 are exposed from the tongue portion 15B of the first insulator 15 in the +X and −X directions. The pair of ground plate connection portions 16C of the mid-plate 16 project from the +Y directional end of the first insulator 15 in the +Y direction.

Figure 14:
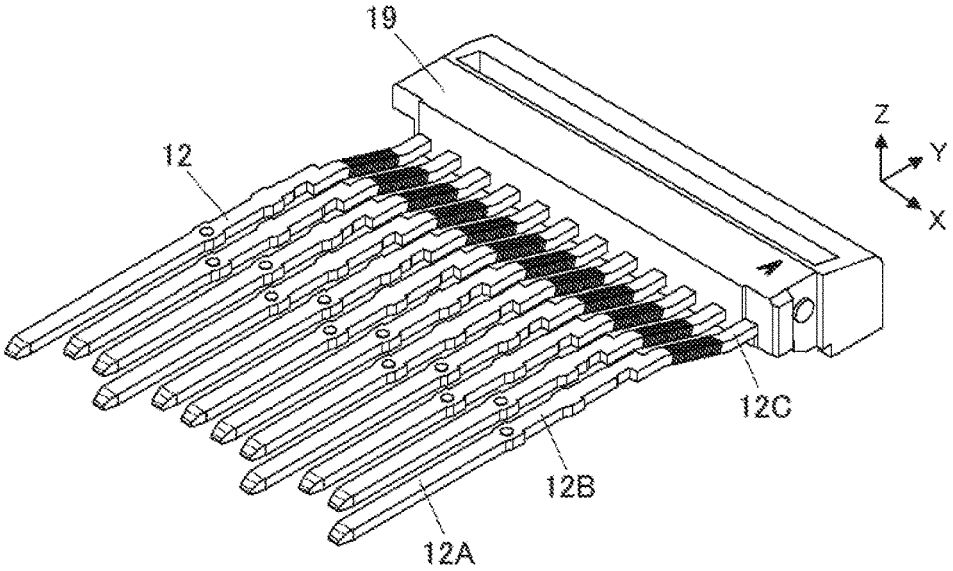
FIG. 14 is a perspective view showing the first contacts held by a first contact insulator.

Next, as shown in FIG. 14, the first contact insulator 19 is molded with insulating resin between the fixed portions 12C and the substrate connection portions 12D of the first contacts 12 shown in FIG. 4. Owing to this, the first contacts 12 are integrally held by the first contact insulator 19.

Figure 15:
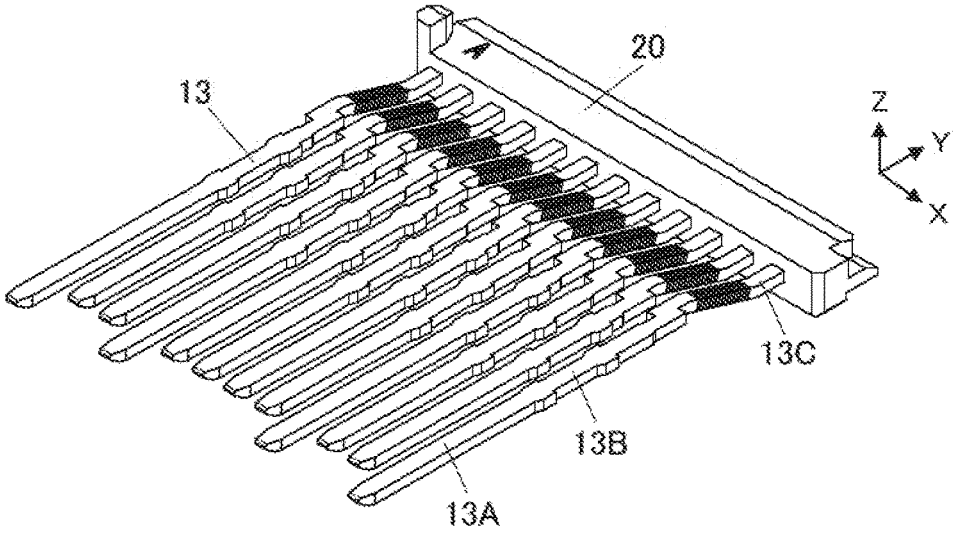
FIG. 15 is a perspective view showing the second contacts held by a second contact insulator.

Likewise, as shown in FIG. 15, the second contact insulator 20 is molded with insulating resin between the fixed portions 13C and the substrate connection portions 13D of the second contacts 13 shown in FIG. 5. Owing to this, the second contacts 13 are integrally held by the second contact insulator 20.

Figure 16:
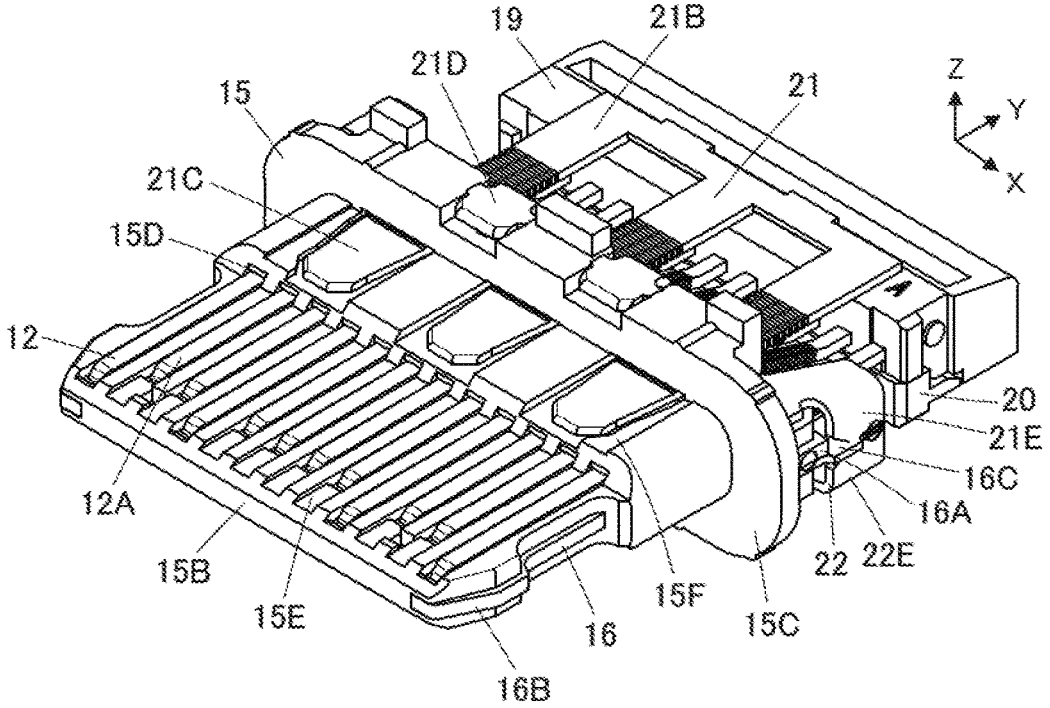
FIG. 16 is a perspective view showing the first contacts, the second contacts, the first ground plate and the second ground plate that are attached to the first insulator.

Subsequently, the press-fitted portions 12B of the first contacts 12 shown in FIG. 14 and the press-fitted portions 13B of the second contacts 13 shown in FIG. 15 are press-fitted into the contact through-holes 15D formed in the first insulator 15 from the +Y direction toward the −Y direction, whereby the first contacts 12 and the second contacts 13 are connected to the first insulator 15 as shown in FIG. 16. At this time, since the first contacts 12 are integrally held by the first contact insulator 19 and the same holds true for the second contacts 13, the press-fitting operation can be efficiently and accurately carried out. The first contact insulator 19 and the second contact insulator 20 are disposed to overlap each other in the Z direction.

In this process, the contact portions 12A of the first contacts 12 and the contact portions 13A of the second contacts 13 are inserted into the corresponding contact grooves 15E of the first insulator 15.

The plate tip ends 21C of the first ground plate 21 are inserted into the slits, which penetrate the wall-like portion 15C of the first insulator 15 in the Y direction, from the +Y direction side of the wall-like portion 15C toward the −Y direction, whereby the first ground plate 21 is disposed in the first insulator 15 such that the plate tip ends 21C lie on the flat surfaces 15F of the first insulator 15 on the +Z direction side. Likewise, although not illustrated, the second ground plate 22 is disposed in the first insulator 15 such that the plate tip ends 22C of the second ground plate 22 lie on the flat surfaces 15F of the first insulator 15 on the −Z direction side.

At this time, the shell connection portions 21D of the first ground plate 21 are situated on the +Z directional end of the wall-like portion 15C of the first insulator 15, and the interconnected plate rear ends 21G are situated so as to come in contact with the +Z direction-side surface of the first contact insulator 19.

Likewise, although not illustrated, the shell connection portions 22D of the second ground plate 22 are situated on the −Z directional end of the wall-like portion 15C of the first insulator 15, and the +Y directional ends of the plate rear ends 22G of the second ground plate 22 are situated so as to come in contact with the −Z direction-side surface of the second contact insulator 20.

The pair of mid-plate connection portions 21E of the first ground plate 21 are situated on the +Z direction-side surfaces of the corresponding ground plate connection portions 16C of the mid-plate 16, and the pair of mid-plate connection portions 22E of the second ground plate 22 are situated on the −Z direction-side surfaces of the corresponding ground plate connection portions 16C of the mid-plate 16.

In this position, the pair of mid-plate connection portions 21E of the first ground plate 21 and the pair of mid-plate connection portions 22E of the second ground plate 22 are welded to the corresponding ground plate connection portions 16C of the mid-plate 16 by, for instance, laser beam welding, whereby the mid-plate 16 is connected to the first ground plate 21 and the second ground plate 22. In addition, the pair of mid-plate lateral members 16B are connected to the mid-plate body 16A by welding together the ground plate connection portions 16C formed at the mid-plate body 16A and the +Y directional ends of the corresponding mid-plate lateral members 16B by, for instance, laser beam welding.

Figure 17:
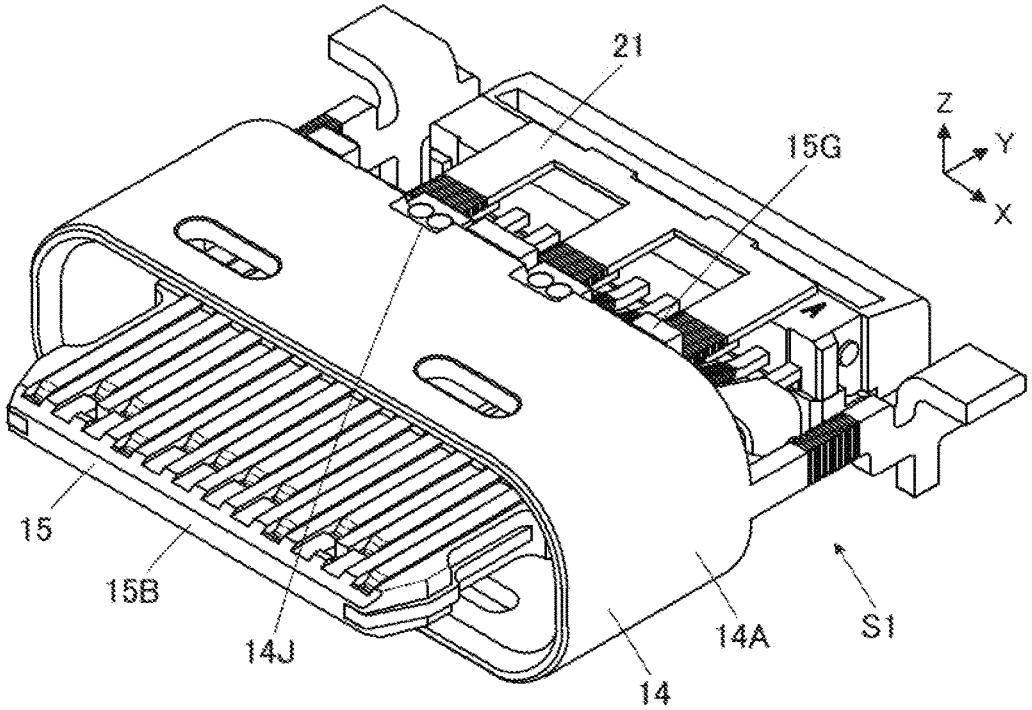
FIG. 17 is a perspective view showing the first insulator covered with the peripheral shell.

Subsequently, as shown in FIG. 17, the tongue portion 15B of the first insulator 15 is inserted into the cylindrical portion 14A of the peripheral shell 14, and the peripheral shell 14 is set from the −Y direction side such that the +Y directional end of the cylindrical portion 14A abuts on the projections 15G of the first insulator 15, thereby covering the peripheral portion of the first insulator 15. At this time, the tongue portion 15B of the first insulator 15 projects in the −Y direction over the −Y directional end of the cylindrical portion 14A of the peripheral shell 14. In addition, at this time, the wall-like portion 15C of the first insulator 15 is inserted into the cylindrical portion 14A of the peripheral shell 14 up to the +Y directional end of the cylindrical portion 14A, and the two ground plate connection portions 14J of the peripheral shell 14 on the +Z direction side overlap the shell connection portions 21D of the first ground plate 21. Although not illustrated, the other two ground plate connection portions 14J of the peripheral shell 14 on the −Z direction side overlap the shell connection portions 22D of the second ground plate 22.

In this position, the ground plate connection portions 14J of the peripheral shell 14 are irradiated from above with a laser beam, for instance, for welding the ground plate connection portions 14J of the peripheral shell 14 to the shell connection portions 21D of the first ground plate 21 and the shell connection portions 22D of the second ground plate 22, correspondingly, whereby the peripheral shell 14 is connected to the first ground plate 21 and the second ground plate 22.

Thus, a subassembly S1 as shown in FIG. 17 is obtained.

Figure 18:
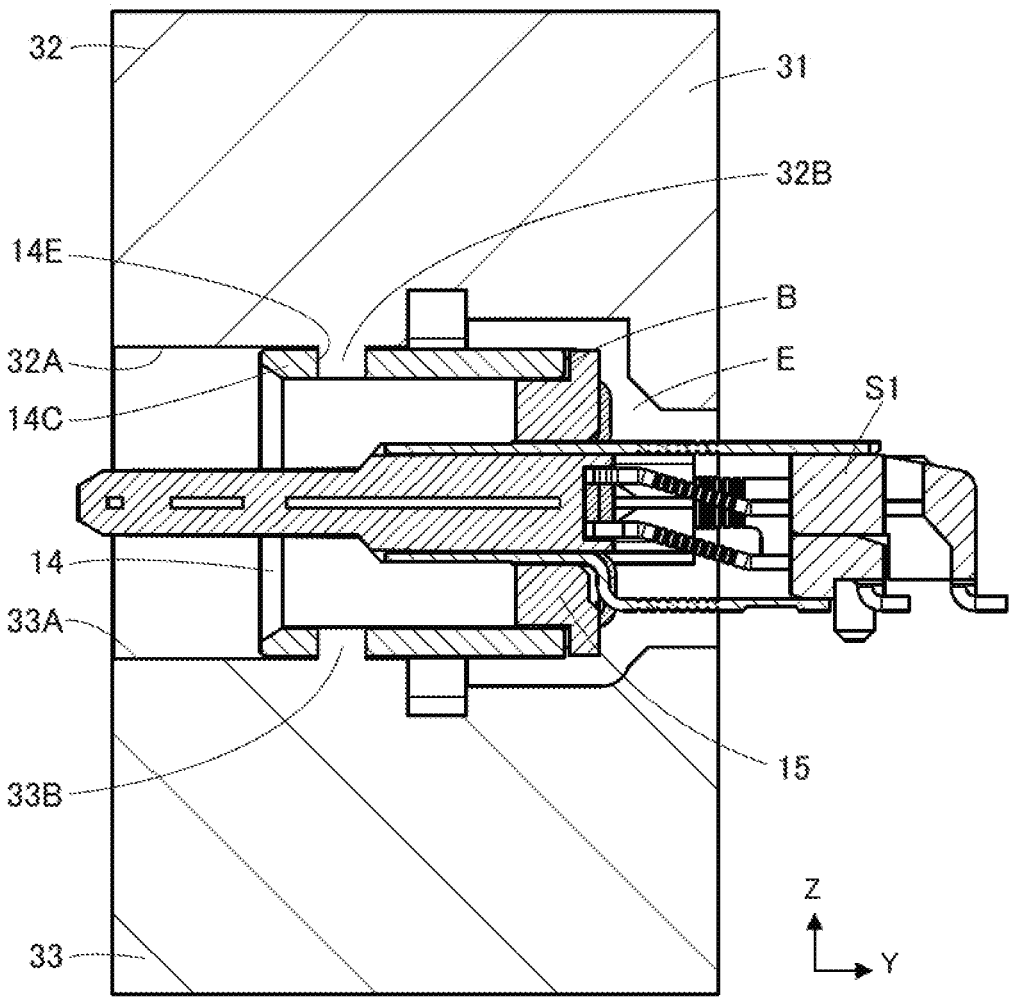
FIG. 18 is a cross-sectional side view showing a subassembly of the waterproof connector according to Embodiment that is placed in a secondary-molding mold before secondary molding.

Next, as shown in FIG. 18, the subassembly S1 is placed in a secondary-molding mold 31 in order to mold the second insulator 17. The secondary-molding mold 31 includes an upper mold 32 situated on the +Z direction side in the subassembly S1 and a lower mold 33 situated on the −Z direction side in the subassembly S1. The upper mold 32 is provided with upper mold projections 32B projecting from an inner surface 32A of the upper mold 32 in the −Z direction, while the lower mold 33 is provided with lower mold projections 33B projecting from an inner surface 33A of the lower mold 33 in the +Z direction.

When the subassembly S1 is placed in the secondary-molding mold 31, the shell front end exposure portion 14C of the peripheral shell 14 comes in contact with the inner surface 32A of the upper mold 32 and the inner surface 33A of the lower mold 33, and a cavity E that is a space surrounded by the inner surfaces 32A and 33A of the upper and lower molds 32 and 33 is formed on the +Y direction side of the shell front end exposure portion 14C of the peripheral shell 14. In addition, the upper mold projections 32B of the upper mold 32 and the lower mold projections 33B of the lower mold 33 are correspondingly fitted in the through-holes 14E formed in the shell front end exposure portion 14C of the peripheral shell 14. Thus, the subassembly S1 is secured with respect to the secondary-molding mold 31.

Figure 19:
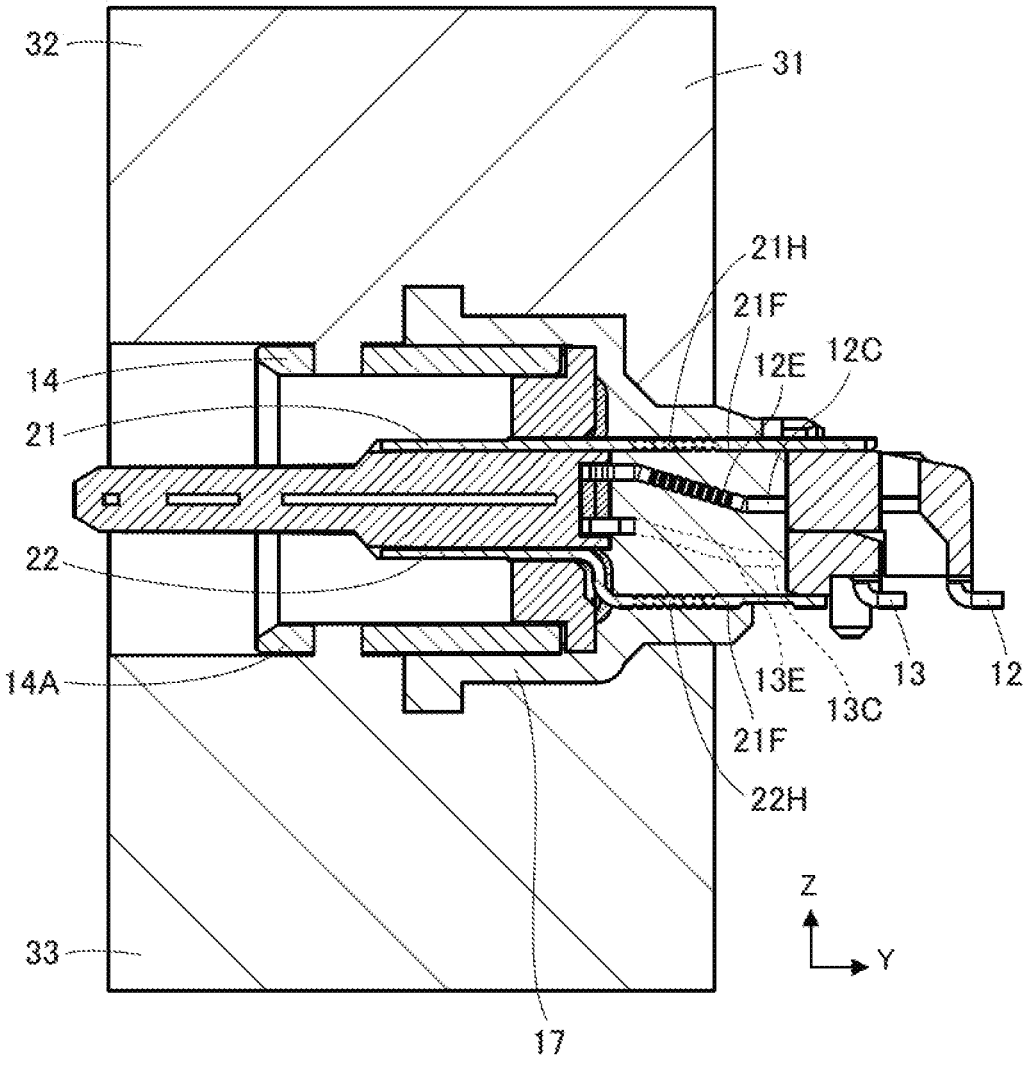
FIG. 19 is a cross-sectional side view showing the subassembly of the waterproof connector according to Embodiment that is placed in the secondary-molding mold after secondary molding.

In this position, molten insulating resin is injected into the cavity E of the secondary-molding mold 31 to thereby mold the second insulator 17 as shown in FIG. 19. In this process, an interface B between the peripheral shell 14 and the first insulator 15 is tightly covered with the second insulator 17, and the peripheral portion of the peripheral shell 14 is tightly covered with the same, with the shell front end exposure portion 14C being exposed.

Note that part of the secondary-molding mold 31 on the +Y direction side is omitted in FIGS. 18 and 19 for ease of illustration.

As a result of molding of the second insulator 17, the fixed portions 12C of the first contacts 12, the fixed portions 13C of the second contacts 13, the +Y direction-side portion of the cylindrical portion 14A of the peripheral shell 14, the plate middle portions 21F of the first ground plate 21, and the plate middle portions 22F of the second ground plate 22 are embedded and fixed in the second insulator 17. Although not illustrated, the middle portions of the peripheral shell arm portions 14F of the peripheral shell 14 are also embedded and fixed in the second insulator 17.

The first contact waterproof shaped portions 12E formed at the fixed portions 12C of the first contacts 12, the second contact waterproof shaped portions 13E formed at the fixed portions 13C of the second contacts 13, the peripheral shell waterproof shaped portions 14H formed at the peripheral shell arm portions 14F (not shown), the first ground plate waterproof shaped portions 21H formed at the plate middle portions 21F of the first ground plate 21, and the second ground plate waterproof shaped portions 22H formed at the plate middle portions 22F of the second ground plate 22 are also embedded in the second insulator 17.

Although not illustrated, the contact portions 12A and the substrate connection portions 12D of the first contacts 12, the contact portions 13A and the substrate connection portions 13D of the second contacts 13, the first contact insulator 19, the second contact insulator 20, the +Y directional ends of the first ground plate arm portions 21B of the first ground plate 21, the +Y directional ends of the second ground plate arm portions 22B of the second ground plate 22, the substrate mount portions 14B of the peripheral shell 14, the shell front end exposure portion 14C of the peripheral shell 14, and part of the back shell connection portions 14G of the peripheral shell 14 are not covered with the second insulator 17, i.e., are exposed.

Figure 20:
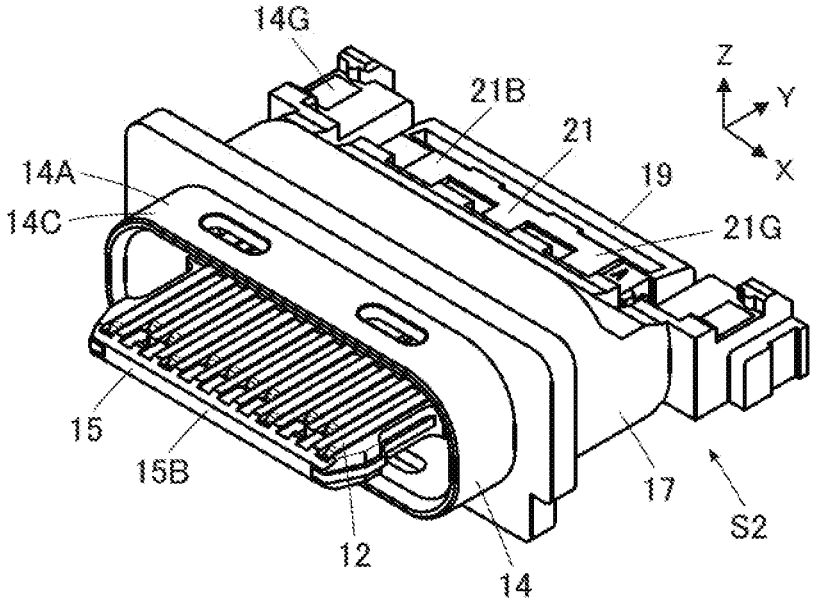
FIG. 20 is a perspective view showing a second insulator molded at a rear portion of the first insulator.

Thus, a subassembly S2 shown in FIG. 20 is obtained. With this subassembly S2, the back shell 18 shown in FIG. 12 is disposed at the rear end of the second insulator 17. At this time, the −Y directional end of the upper surface portion 18A of the back shell 18 overlaps the plate rear ends 21G of the first ground plate 21 that are exposed from the second insulator 17, and the pair of overhanging portions 18C of the back shell 18 overlap the back shell connection portions 14G of the peripheral shell 14 that are exposed from the second insulator 17.

In this position, the back shell 18 is irradiated with a laser beam whereby the upper surface portion 18A of the back shell 18 is welded to the plate rear ends 21G of the first ground plate 21 and the pair of overhanging portions 18C of the back shell 18 is welded to the back shell connection portions 14G of the peripheral shell 14.

As a result, the back shell 18 is connected to the first ground plate 21 and the peripheral shell 14.

Thus, the peripheral shell 14, the mid-plate 16, the back shell 18, the first ground plate 21 and the second ground plate 22 are electrically connected to each other.

The waterproof connector 11 shown in FIG. 1 is manufactured in this manner.

In this state, as shown in FIG. 2, the substrate connection portions 12D of the first contacts 12, the substrate connection portions 13D of the second contacts 13, the substrate mount portions 14B of the peripheral shell 14, and the substrate mount portions 18D of the back shell 18 project from the waterproof connector 11 in the −Z direction.

Figure 21:
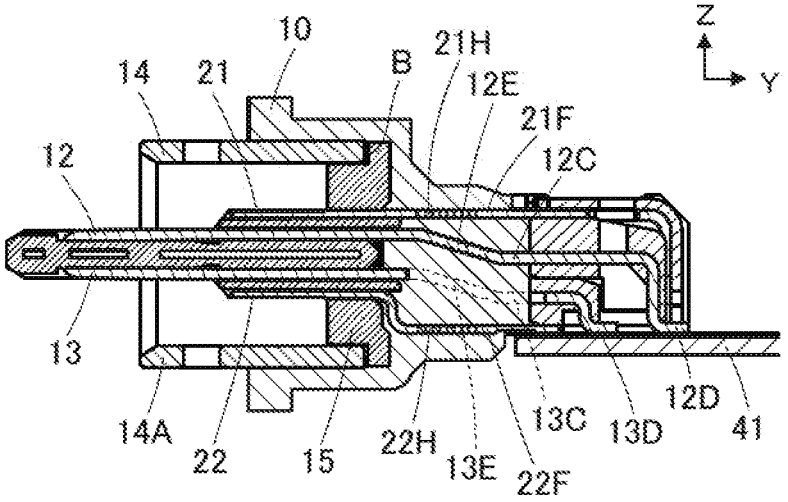
FIG. 21 is a cross-sectional side view showing the waterproof connector according to Embodiment that is mounted on a substrate.
Figure 22:
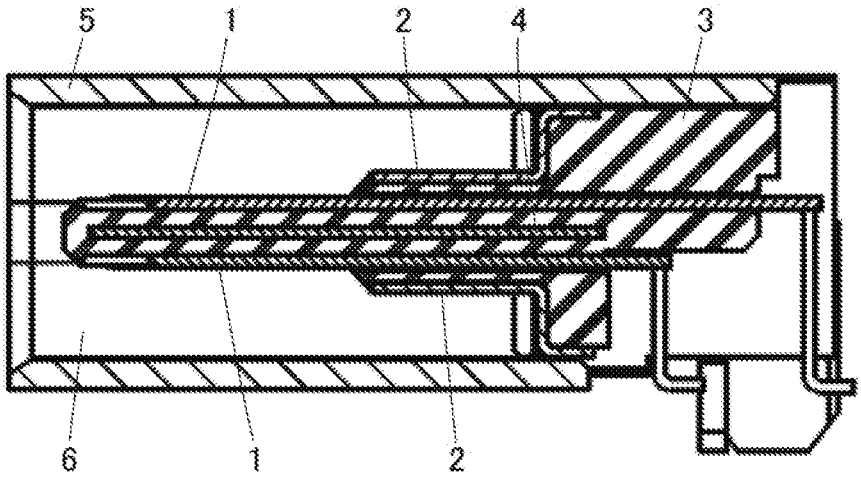
FIG. 22 PRIOR ART
FIG. 22 is a cross-sectional view of a conventional waterproof connector.

The waterproof connector 11 configured as above is mounted on a substrate 41 installed in a device such as a mobile device or an information appliance, as shown in FIG. 21. At this time, although not illustrated, the substrate connection portions 12D of the first contacts 12, the substrate connection portions 13D of the second contacts 13, the substrate mount portions 14B of the peripheral shell 14, and the substrate mount portions 18D of the back shell 18, all of which project from the waterproof connector 11 in the −Z direction, are separately soldered to connection pads (not shown) of the substrate 41, whereby the waterproof connector 11 is connected and fixed to the substrate 41.

In addition, when the substrate mount portions 14B of the peripheral shell 14 and the substrate mount portions 18D of the back shell 18 are separately connected to the corresponding connection pads of the substrate 41 and brought to ground potential, the mid-plate 16, the first ground plate 21, the second ground plate 22, the peripheral shell 14 and the back shell 18 are to be all at ground potential accordingly, which makes it possible to carry out highly reliable signal transmission while reducing the influence of electromagnetic waves.

As shown in FIG. 21, the second insulator 17 tightly covers the rear half of the cylindrical portion 14A of the peripheral shell 14 and the interface B between the peripheral shell 14 and the first insulator 15, which leads to improved waterproof properties at the interface B between the peripheral shell 14 and the first insulator 15.

The fixed portions 12C of the first contacts 12, the fixed portions 13C of the second contacts 13, the plate middle portions 21F of the first ground plate 21, and the plate middle portions 22F of the second ground plate 22 are embedded in the second insulator 17. Those portions embedded in the second insulator 17 are separately formed with the first contact waterproof shaped portions 12E, the second contact waterproof shaped portions 13E, the first ground plate waterproof shaped portions 21H and the second ground plate waterproof shaped portions 22H, each of which is made up of a plurality of grooves.

Therefore, even if water penetrates between any of the first contacts 12, the second contacts 13, the first ground plate 21 and the second ground plate 22 and the second insulator 17 from the counter-connector accommodation portion 11A side of the waterproof connector 11, the foregoing water proof shaped portions serve to block the water and prevent water from reaching the back of the second insulator 17. Since, although not illustrated, the middle portions of the peripheral shell arm portions 14F are also embedded in the second insulator 17 with the middle portions being formed with the peripheral shell waterproof shaped portions 14H made up of a plurality of grooves, even if water penetrates between the peripheral shell 14 and the second insulator 17 from the counter-connector accommodation portion 11A side of the waterproof connector 11, the peripheral shell waterproof shaped portions 14H serve to block the water and prevent water from reaching the back of the second insulator 17.

The first ground plate 21 and the second ground plate 22 are arranged to sandwich the first contacts 12 and the second contacts 13 in the Z direction. This arrangement may lead to decreased mold shrinkage of resin constituting the second insulator 17 in a space sandwiched between the first ground plate 21 and the second ground plate 22 in molding of the second insulator 17. In other words, the adhesion of the second insulator 17 to the fixed portions 12C of the first contacts 12 and the fixed portions 13C of the second contacts 13 may be lower compared to the case where neither the first ground plate 21 nor the second ground plate 22 is provided.

However, the fixed portions 12C of the first contacts 12 and the fixed portions 13C of the second contacts 13 in Embodiment are inclined so as to be displaced in the −Z direction as advancing in the +Y direction; therefore, compared to the case where the fixed portions 12C of the first contacts 12 and the fixed portions 13C of the second contacts 13 extend along the Y direction without inclination, the first contact waterproof shaped portions 12E and the second contact waterproof shaped portions 13E can be formed over a longer distance. Accordingly, even if the adhesion of the second insulator 17 to the fixed portions 12C of the first contacts 12 and the fixed portions 13C of the second contacts 13 becomes lower due to the presence of the first ground plate 21 and the second ground plate 22, water penetrating from the counter-connector accommodation portion 11A side of the waterproof connector 11 can be still adequately blocked.

The fixed portions 12C of the first contacts 12 and the fixed portions 13C of the second contacts 13 are inclined and therefore can be reduced in size in the Y direction while ensuring sufficient waterproof properties. Thus, the external size of the waterproof connector 11 in the Y direction can be reduced.

The four through-holes 14E are formed in the shell front end exposure portion 14C of the peripheral shell 14. When the substrate 41 connected to the waterproof connector 11 has therein an antenna for transmitting and receiving radio waves, radio waves transmitted and received with the antenna can go through the through-holes 14E, and this makes it possible to reduce the interference of the cylindrical portion 14A of the peripheral shell 14 with radio waves.

As shown in FIG. 21, the cylindrical portion 14A of the metallic peripheral shell 14 does not cover the whole of the contact portions 12A and 13A of the first and second contacts 12 and 13 and has a small length in the Y direction such that the −Y directional ends of the first and second contacts 12 and 13 project from the cylindrical portion 14A in the −Y direction. Owing to this configuration, even when, for example, the substrate 41 is installed in a device having therein an antenna for transmitting and receiving radio waves, the influence of the cylindrical portion 14A of the metallic peripheral shell 14 exerted on transmission and reception of radio waves can be mitigated, making it possible to transmit and receive radio waves with higher intensity. Thus, the cylindrical portion 14A having a small length in the Y direction is advantageous for, for example, a device that transmits and receives radio waves to and from an external device.

When, for instance, the substrate 41 is installed in a device not having an antenna for transmitting and receiving radio waves, the cylindrical portion 14A may have a larger length in the Y direction, in other words, the length of the cylindrical portion 14A in the Y direction may be designed to cover the whole of the contact portions 12A and 13A of the first and second contacts 12 and 13.

In Embodiment, the subassembly S1 is secured in position by fitting the upper mold projections 32B and the lower mold projections 33B of the secondary-molding mold 31 into the through-holes 14E formed in the shell front end exposure portion 14C of the peripheral shell 14; however, for instance, particularly when transmission and reception of radio waves at the substrate 41 connected to the waterproof connector 11 need not be taken into account, instead of the through-holes 14E, recesses may be formed in the shell front end exposure portion 14C so as to receive the upper mold projections 32B and the lower mold projections 33B of the secondary-molding mold 31. Alternatively, instead of the through-holes 14E, protrusions may be formed on the shell front end exposure portion 14C while recesses may be formed in the inner surfaces 32A and 33A of the upper and lower molds 32 and 33 of the secondary-molding mold 31 for example, so as to allow the protrusions of the shell front end exposure portion 14C to be fitted into the recesses of the secondary-molding mold 31.

Thus, the embodiment in which the through-holes 14E are formed in the shell front end exposure portion 14C of the peripheral shell 14 is not the sole case, and the subassembly S1 can be secured in position by fitting protrusions formed on one of the secondary-molding mold 31 and the shell front end exposure portion 14C of the peripheral shell 14 into recesses formed in the other thereof.

While the through-holes 14E formed in the shell front end exposure portion 14C of the peripheral shell 14 penetrate either of the pair of flat portions 14D of the shell front end exposure portion 14C, the through-holes 14E may penetrate anywhere in the shell front end exposure portion 14C; for instance, the through-holes 14E may penetrate the shell front end exposure portion 14C in the X direction perpendicular to the fitting direction.

While, in Embodiment, the number of the through-holes 14E formed in the shell front end exposure portion 14C is four, it is not limited as long as the upper and lower mold projections 32B and 33B of the secondary-molding mold 31 can be fitted in the through-holes 14E so that the subassembly S1 is secured, and one to three or five or more through-holes 14E may be formed in the shell front end exposure portion 14C.

While, in Embodiment, the through-holes 14E are formed to penetrate the flat portions 14D of the shell front end exposure portion 14C in the Z direction, they may be formed to penetrate the shell front end exposure portion 14C in a direction intersecting the fitting direction of the waterproof connector 11 as long as the upper and lower mold projections 32B and 33B of the upper and lower molds 32 and 33 of the secondary-molding mold 31 can be fitted in the through-holes 14E. For example, the through-holes 14E may penetrate the flat portions 14D of the shell front end exposure portion 14C in a direction inclined with respect to the Z direction toward the X direction and the Y direction.

The peripheral shell 14 is made of a metal material; therefore, even if rubbed by a shell or a housing of a counter connector (not shown) at insertion or removal of the counter connector to or from the counter-connector accommodation portion 11A of the waterproof connector 11, the peripheral shell 14 is unlikely to be broken and has a sufficient mechanical strength.

When such a sufficient mechanical strength is not required, however, the peripheral shell 14 need not be made of a metal material and may be made of a resin material. By using the peripheral shell 14 made of a resin material, even when the waterproof connector 11 is attached to a device having therein an antenna for transmitting and receiving radio waves, interference with transmission and reception of radio waves can be avoided.

What is claimed is:

1. A waterproof connector to be mounted on a substrate, comprising:

one or more contacts;

a peripheral shell in a cylindrical shape surrounding the one or more contacts and including a counter-connector accommodation portion that opens frontward in a fitting direction; and a housing made of insulating resin and holding the one or more contacts and the peripheral shell, wherein the peripheral shell includes a shell front end exposure portion in a cylindrical shape that is situated at a front end of the peripheral shell in the fitting direction and is exposed from the housing, and one or more through-holes that penetrate the shell front end exposure portion in a direction intersecting the fitting direction, and wherein the housing tightly covers a whole circumference of a cylindrical rear half portion of the peripheral shell located behind the shell front end exposure portion in the fitting direction with the shell front end exposure portion being exposed.

2. The waterproof connector according to claim 1, wherein the peripheral shell includes a pair of flat portions facing each other, and wherein the one or more through-holes are formed in each of the pair of flat portions.

3. The waterproof connector according to claim 1, wherein the housing includes a first insulator holding the one or more contacts and closing a rear end portion of the peripheral shell, and a second insulator tightly covering a whole circumference of the cylindrical rear half portion of the peripheral shell and an interface between the peripheral shell and the first insulator.

4. The waterproof connector according to claim 3, wherein each of the one or more contacts includes a contact portion exposed frontward in the fitting direction from the first insulator, a substrate connection portion exposed rearward in the fitting direction from the second insulator to be connected to the substrate, and a fixed portion interconnecting the contact portion and the substrate connection portion and embedded in the second insulator, and wherein the fixed portion extends in a direction inclined with respect to the fitting direction, and a contact waterproof shaped portion blocking entry of water along an interface between the fixed portion and the second insulator is formed in a surface of the fixed portion.

5. The waterproof connector according to claim 4, wherein the contact portion of each of the one or more contacts projects frontward in the fitting direction beyond the shell front end exposure portion of the peripheral shell.

6. The waterproof connector according to claim 3, further comprising a ground plate that is held by the first insulator and the second insulator and is to be connected to the substrate, wherein the ground plate includes a ground plate tip end exposed frontward in the fitting direction from the first insulator and situated inside the counter-connector accommodation portion, a ground plate rear end exposed rearward in the fitting direction from the second insulator to be connected to the substrate, and a ground plate middle portion interconnecting the ground plate tip end and the ground plate rear end and embedded in the second insulator while extending along the one or more contacts, and wherein a ground plate waterproof shaped portion for blocking entry of water along an interface between the ground plate middle portion and the second insulator is formed in a surface of the ground plate middle portion.

7. The waterproof connector according to claim 3, wherein the peripheral shell includes a cylindrical portion including the shell front end exposure portion, a peripheral shell rear end exposed rearward in the fitting direction from the second insulator, and a peripheral shell middle portion interconnecting the cylindrical portion and the peripheral shell rear end and embedded in the second insulator, and wherein a peripheral shell waterproof shaped portion for blocking entry of water along an interface between the peripheral shell middle portion and the second insulator is formed in a surface of the peripheral shell middle portion.

8. A method of manufacturing a waterproof connector having one or more contacts, a peripheral shell in a cylindrical shape surrounding the one or more contacts and including a counter-connector accommodation portion that opens frontward in a fitting direction, and a housing made of insulating resin and holding the one or more contacts and the peripheral shell, the peripheral shell including a shell front end exposure portion in a cylindrical shape that is situated at a front end of the peripheral shell in the fitting direction and is exposed from the housing, the method comprising the steps of:

forming a subassembly in which the peripheral shell is disposed against the one or more contacts to surround the one or more contacts;

securing the subassembly in position by fitting a protrusion formed on one of a molding mold and the shell front end exposure portion of the peripheral shell into a recess formed in the other of the molding mold and the shell front end exposure portion of the peripheral shell; and injecting molten insulating resin into the molding mold such that a whole circumference of a cylindrical rear half portion of the peripheral shell located behind the shell front end exposure portion in the fitting direction is tightly covered with the insulating resin while the shell front end exposure portion is exposed.

9. The method of manufacturing a waterproof connector according to claim 8, wherein the subassembly has a first insulator holding the one or more contacts and closing a rear end portion of the peripheral shell, wherein a second insulator tightly covering the whole circumference of the cylindrical rear half portion of the peripheral shell and an interface between the peripheral shell and the first insulator is molded by injecting molten insulating resin into the molding mold, and wherein the first insulator and the second insulator constitute the housing.

10. The method of manufacturing a waterproof connector according to claim 8, wherein the protrusion is formed on the molding mold, and wherein the recess comprises a through-hole formed in the shell front end exposure portion of the peripheral shell.

* * * * *